US009853423B1

(12) United States Patent
Sumoyama et al.

(10) Patent No.: US 9,853,423 B1
(45) Date of Patent: Dec. 26, 2017

(54) SPARK PLUG

(71) Applicant: NGK SPARK PLUG CO., LTD., Nagoya-shi, Aichi (JP)

(72) Inventors: Daisuke Sumoyama, Nagoya (JP); Takuto Nakada, Komaki (JP); Tsutomu Shibata, Owariasahi (JP); Takaaki Kikai, Ichinomiya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/646,559

(22) Filed: Jul. 11, 2017

(30) Foreign Application Priority Data

Jul. 13, 2016 (JP) ..... 2016-138603
May 17, 2017 (JP) ..... 2017-097916

(51) Int. Cl.
*H01T 13/32* (2006.01)
*H01T 13/10* (2006.01)
*H01T 13/39* (2006.01)
*H01T 13/38* (2006.01)

(52) U.S. Cl.
CPC ..... *H01T 13/39* (2013.01); *H01T 13/10* (2013.01); *H01T 13/32* (2013.01); *H01T 13/38* (2013.01)

(58) Field of Classification Search
CPC ..... H01T 13/39; H01T 13/10; H01T 13/32; H01T 13/38
See application file for complete search history.

(56) References Cited

U.S. PATENT DOCUMENTS 5,101,135 A * 3/1992 Oshima ..... H01T 21/02 313/11.5
7,569,979 B2 8/2009 Lykowski et al.
8,575,829 B2 * 11/2013 Ma ..... H01T 13/39 313/118
2007/0236123 A1 * 10/2007 Lykowski ..... H01T 13/20 313/141
2010/0109502 A1 * 5/2010 Nakayama ..... H01T 13/32 313/141
2013/0099654 A1 * 4/2013 Ma ..... H01T 13/39 313/141
2013/0216846 A1 8/2013 Bao et al.
2015/0380907 A1 * 12/2015 Kawashima ..... H01T 13/32 313/141
2017/0033539 A1 * 2/2017 Segawa ..... H01T 13/50

FOREIGN PATENT DOCUMENTS

WO 2012/033160 A1 3/2012

* cited by examiner

*Primary Examiner* — Mariceli Santiago
(74) *Attorney, Agent, or Firm* — Stites & Harbison, PLLC; Jeffrey A. Haeberlin

(57) ABSTRACT

At least one of a center electrode and a ground electrode of a spark plug includes an electrode body, an electrode tip, and a welded portion formed between the electrode body and the electrode tip. The electrode tip includes a cover layer that covers at least a side surface of a tip body, and the cover layer is formed of IrAl. On a section formed by cutting the electrode tip near a boundary with the welded portion, an area of the tip body is represented by Sa. An area of a projection on the section of a non-contact portion of an opposite surface of the tip body not in contact with the welded portion is represented by Sb. In this case, Sa−Sb corresponds to 35% or more of Sa.

5 Claims, 9 Drawing Sheets

SPARK PLUG

CROSS REFERENCE TO RELATED APPLICATION

The present application claims priority to Japanese Patent Application No. 2016-138603, filed Jul. 13, 2016, and Japanese Patent Application No. 2017-097916 filed May 17, 2017, the entire disclosures of which are hereby incorporated herein by reference.

BACKGROUND OF THE INVENTION

Field of the Invention

The present description relates to a spark plug for causing fuel gas to ignite in an internal combustion engine or the like.

Description of the Related Art

Spark plugs used in internal combustion engines cause, for example, spark discharge in a gap formed between a center electrode and a ground electrode to cause fuel gas to ignite in an internal combustion engine or the like. A spark plug is known in which, in order to improve wear resistance, an electrode tip formed of a noble metal such as iridium is bonded to a portion of a center electrode or a ground electrode, the portion forming a gap where spark discharge occurs.

Patent Literature 1 discloses a material including an iridium (Ir) alloy whose surface is covered with a film formed of an IrAl intermetallic compound. Patent Literature 1 discloses that this material has good high-temperature oxidation resistance.

PATENT LITERATURE

PTL 1 is PCT International Application Publication No. WO 2012/033160 A1.

BRIEF SUMMARY OF THE INVENTION

There have not been sufficient studies on applications of the above-described material to an electrode tip of a spark plug. In particular, there have not been sufficient studies on bonding of an electrode tip formed by using the material and an electrode body to each other, and thus it may be difficult to sufficiently ensure separation resistance of the electrode tip.

The present description discloses, in a spark plug that includes an electrode tip having a cover layer formed of an IrAl intermetallic compound, a technology for improving separation resistance of the electrode tip.

The technology disclosed in the present description may be realized by way of the following application examples.

Application Example 1

A spark plug includes a center electrode and a ground electrode disposed so as to form a gap between the center electrode and the ground electrode. At least one of the center electrode and the ground electrode includes an electrode body, an electrode tip having a discharge surface that faces the gap, and a welded portion formed between the electrode body and the electrode tip and containing a component of the electrode body and a component of the electrode tip. The electrode tip includes a tip body having (i.e. comprising) a side surface extending in a direction that intersects the discharge surface and an opposite surface which is disposed on an opposite side of the discharge surface. At least a part of the opposite surface is in contact with the welded portion, and at least a part of the opposite surface is a non-contact portion not in contact with the welded portion. The electrode tip also includes a cover layer that covers at least the side surface of the tip body. The tip body is formed of (i.e., comprises) iridium (Ir) or an alloy containing iridium (Ir) as a main component. The cover layer is a layer formed of (i.e., comprising) an intermetallic compound (IrAl) of iridium (Ir) and aluminum (Al) and having a thickness of 50 μm or less. The electrode body is formed of (i.e., comprises) an alloy containing 50% by weight or more of nickel (Ni). On a particular section formed by cutting the electrode tip along a plane that is located near a boundary between the welded portion and the electrode tip, that is parallel to the discharge surface, that intersects the electrode tip, and that does not intersect the welded portion, an area of the tip body is represented by Sa. In other words, "Sa" is defined as an area of a section through the tip body along a plane located near but not intersecting the welded portion, and parallel to the discharge surface. An area of the non-contact portion of the opposite surface is represented by Sb, the area of the non-contact portion being determined by projecting the non-contact portion on the particular section in a direction perpendicular to the discharge surface. In other words, "Sb" is defined as an area of a projection of the non-contact portion of the opposite surface on the section in a direction perpendicular to the discharge surface. An area (Sa−Sb) of a bonding portion of the tip body, the bonding portion being bonded to the electrode body with the welded portion therebetween, corresponds to 35% or more of the area Sa of the tip body. In other words, Sa−Sb corresponds to 35% or more of Sa.

With this structure, the tip body and the electrode body can be bonded to each other by the welded portion on a sufficiently large area. As a result, in the spark plug that includes an electrode tip having a cover layer formed of an IrAl intermetallic compound, separation resistance of the electrode tip can be improved.

Application Example 2

In the spark plug described in Application example 1, the area (Sa−Sb) of the bonding portion preferably corresponds to 45.7% or more of the area Sa of the tip body. In other words, Sa−Sb corresponds to 45.7% or more of Sa.

With this structure, the tip body and the electrode body can be bonded to each other by the welded portion on a larger area. As a result, in the spark plug that includes an electrode tip having a cover layer formed of an IrAl intermetallic compound, separation resistance of the electrode tip can be further improved.

Application Example 3

In the spark plug described in Application example 1 or 2, when an area of an exposed portion of a surface of the electrode tip is represented by Sc, the area (Sa−Sb) of the bonding portion preferably corresponds to 7% or more of the area Sc. In other words, "Sc" is defined as an area of an exposed portion of a surface of the electrode tip, and Sa−Sb preferably corresponds to 7% or more of Sc.

With this structure, the tip body and the electrode body can be bonded to each other on a sufficiently large area with respect to the area Sc of a portion of the electrode tip, the portion receiving heat. As a result, in the spark plug that includes an electrode tip having a cover layer formed of an IrAl intermetallic compound, separation resistance of the electrode tip can be further improved.

Application Example 4

In the spark plug described in any one of Application examples 1 to 3, a content of aluminum (Al) in the welded portion in a vicinity of a boundary between the tip body and the welded portion is preferably 10% by mass or less.

With an increase in the aluminum content in the welded portion, the welded portion becomes unlikely to deform and tends to become brittle. This structure suppresses a phenomenon that the welded portion is unlikely to deform and becomes brittle in the vicinity of the boundary between the tip body and the welded portion. Thus, separation resistance of the electrode tip can be further improved.

Application Example 5

In the spark plug described in Application example 4, the content of aluminum (Al) in the welded portion in a vicinity of a boundary between the tip body and the welded portion is preferably 5% by mass or less.

This structure further suppresses a phenomenon that the welded portion is unlikely to deform and becomes brittle in the vicinity of the boundary between the tip body and the welded portion. Thus, separation resistance of the electrode tip can be particularly improved.

The present invention may be implemented in various embodiments. For example, the present invention may be implemented in embodiments of a spark plug, an ignition system using the spark plug, an internal combustion engine mounting the spark plug, an internal combustion engine mounting the ignition system using the spark plug, and an electrode of a spark plug.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE INVENTION

A. First Embodiment

A-1. Structure of Spark Plug

Figure 1:
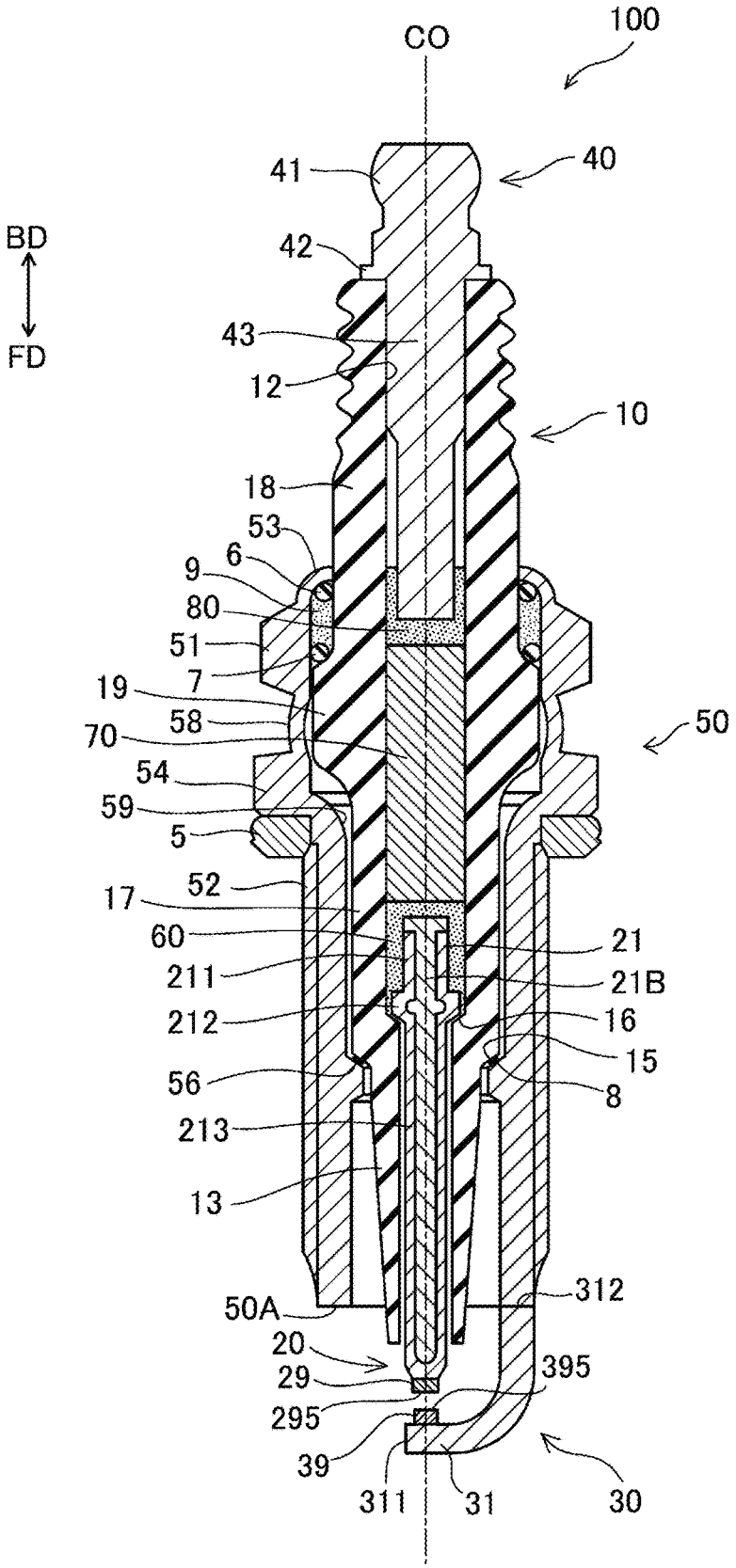
FIG. 1 is a sectional view of a spark plug 100 according to an embodiment.

FIG. 1 is a sectional view of a spark plug 100 according to an embodiment. The one-dotted chain line in FIG. 1 indicates an axial line CO of the spark plug 100. A direction parallel to the axial line CO (up-down direction in FIG. 1) may be referred to as an "axial line direction". A radial direction of a circle centered at the axial line CO may be simply referred to as a "radial direction". A circumferential direction of a circle centered at the axial line CO may be simply referred to as a "circumferential direction". The down direction in FIG. 1 may be referred to as a "forward direction FD", and the up direction in FIG. 1 may be referred to as a "backward direction BD". The lower side in FIG. 1 is referred to as a "front side" of the spark plug 100, and the upper side in FIG. 1 is referred to as a "back side" of the spark plug 100. The spark plug 100 includes an insulator 10 serving as an insulator, a center electrode 20, a ground electrode 30, a terminal nut 40, and a metal shell 50.

The insulator 10 formed by firing alumina or the like. The insulator 10 is a substantially cylindrical member extending in the axial line direction and having a penetration hole 12 (axial hole) penetrating the insulator 10. The insulator 10 includes a flange 19, a back body 18, a front body 17, a stepped portion 15, and a long leg portion 13. The back body 18 is disposed on the back side of the flange 19 and has an outer diameter smaller than that of the flange 19. The front body 17 is disposed on the front side of the flange 19 and has an outer diameter smaller than that of the flange 19. The long leg portion 13 is disposed on the front side of the front body 17 and has an outer diameter smaller than that of the front body 17. In the state in which the spark plug 100 is attached to an internal combustion engine (not shown), the long leg portion 13 is exposed in a combustion chamber of the internal combustion engine. The stepped portion 15 is formed between the long leg portion 13 and the front body 17.

The metal shell 50 is a cylindrical metal shell that is formed of a conductive metal material (for example, low-carbon steel) and that is used for fixing the spark plug 100 to an engine head (not shown) of an internal combustion engine. The metal shell 50 has an insertion hole 59 penetrating along the axial line CO. The metal shell 50 is disposed on the periphery (that is, outer circumference) of the insulator 10 in the radial direction. Specifically, the insulator 10 is inserted and held in the insertion hole 59 of the metal shell 50. The front end of the insulator 10 protrudes to the front side of the front end of the metal shell 50. The back end of the insulator 10 protrudes to the back side of the back end of the metal shell 50.

The metal shell 50 includes a tool engagement portion 51 which has a hexagonal prism shape and with which a spark plug wrench is engaged, a threaded portion 52 for attaching to an internal combustion engine, and a flange-shaped seat 54 formed between the tool engagement portion 51 and the threaded portion 52. The nominal diameter of the threaded portion 52 is any of, for example, M8 (8 mm (millimeters)), M10, M12, M14, and M18.

An annular gasket 5 formed by bending a metal plate is fitted between the threaded portion 52 and the seat 54 of the metal shell 50. When the spark plug 100 is attached to an internal combustion engine, the gasket 5 seals the gap between the spark plug 100 and the internal combustion engine (engine head).

The metal shell 50 further includes a thin-walled crimping portion 53 provided on the back side of the tool engagement portion 51 and a thin-walled compressive deformation portion 58 provided between the seat 54 and the tool engagement portion 51. Annular ring members 6 and 7 are disposed in an annular region formed between the inner peripheral surface of a portion of the metal shell 50, the portion extending from the tool engagement portion 51 to the crimping portion 53, and the outer peripheral surface of the back body 18 of the insulator 10. The space between the two ring members 6 and 7 in this region is filled with a powder of talc 9. The back end of the crimping portion 53 is bent radially inward and fixed to the outer peripheral surface of the insulator 10. The compressive deformation portion 58 of the metal shell 50 is subjected to compressive deformation when the crimping portion 53 fixed to the outer peripheral surface of the insulator 10 is pressed onto the front side in the manufacturing process. Owing to the compressive deformation of the compressive deformation portion 58, the insulator 10 is pressed onto the front side in the metal shell 50 through the ring members 6 and 7 and the talc 9. The stepped portion 15 of the insulator 10 (stepped portion on the insulator side) is pressed by a stepped portion 56 formed on the inner periphery of the threaded portion 52 of the metal shell 50 (stepped portion on the metal shell side) with an annular metal sheet packing 8 interposed therebetween. As a result, the sheet packing 8 prevents the gas in the combustion chamber of the internal combustion engine from leaking out through the gap between the metal shell 50 and the insulator 10.

The center electrode 20 includes a bar-shaped center electrode body 21 extending in the axial line direction and a center electrode tip 29. The center electrode body 21 is held in a front-side portion of the penetration hole 12 of the insulator 10. A core 21B is embedded in the center electrode body 21. The center electrode body 21 is formed by using, for example, nickel (Ni) or an alloy containing Ni in an amount of 50% by weight or more (for example, INC600 or INC601). The core 21B is formed of copper or an alloy containing copper as a main component, which has higher thermal conductivity than the alloy that forms the center electrode body 21. In the present embodiment, the core 21B is formed of copper.

The center electrode body 21 includes a flange 212 disposed at a predetermined position in the axial line direction, a head 211 (electrode head) which is a portion on the back side of the flange 212, and a leg 213 (electrode leg) which is a portion on the front side of the flange 212. The flange 212 is supported on a stepped portion 16 of the insulator 10. A front-end portion of the leg 213, that is, the front end of the center electrode body 21 protrudes to the front side with respect to the front end of the insulator 10.

The center electrode tip 29 is a member having a substantially columnar shape and is bonded to the front end of the center electrode body 21 (front end of the leg 213) by, for example, laser welding. The front-end face of the center electrode tip 29 is a first discharge surface 295 that forms a gap (may be referred to as a "spark gap") in which spark discharge occurs between the center electrode tip 29 and a ground electrode tip 39 described below. The center electrode tip 29 will be described in detail below.

The ground electrode 30 includes a ground electrode body 31 bonded to the front end of the metal shell 50 and a ground electrode tip 39 having a substantially columnar shape. The ground electrode body 31 is a curved bar having a quadrangular section. The ground electrode body 31 has, as both end faces, a free end face 311 and a bonding end face 312. The bonding end face 312 is bonded to a front-end face 50A of the metal shell 50 by, for example, resistance welding. Accordingly, the metal shell 50 and the ground electrode body 31 are electrically connected to each other. The ground electrode body 31 is curved, and one side surface of the ground electrode body 31 faces the center electrode tip 29 of the center electrode 20 on the axial line CO in the axial line direction.

The ground electrode body 31 is formed by using, for example, Ni or an alloy containing Ni in an amount of 50% by weight or more (for example, INC600 or INC601). The ground electrode body 31 may include a core embedded therein, the core being formed of a metal (for example, copper) having higher thermal conductivity than the ground electrode body 31.

The ground electrode tip 39 is welded on the one side surface near the free end face 311 and at a position facing the center electrode tip 29. The ground electrode tip 39 is formed of, for example, iridium (Ir) or an alloy containing, as a main component, a noble metal such as platinum (Pt). The back-end face of the ground electrode tip 39 is a second discharge surface 395 that faces the first discharge surface 295 of the center electrode tip 29 and that forms a gap between the second discharge surface 395 and the first discharge surface 295.

The terminal nut 40 is a bar-shaped member that extends in the axial line direction. The terminal nut 40 is formed of a conductive metal material (for example, a low-carbon steel), and the surface thereof is covered with a metal layer (for example, a Ni layer) for preventing corrosion, the metal layer being formed by plating or the like. The terminal nut 40 includes a flange 42 (terminal flange) formed at a predetermined position in the axial line direction, a cap attachment portion 41 disposed on the back side of the flange 42, and a leg 43 (terminal leg) disposed on the front side of the flange 42. The cap attachment portion 41 of the terminal nut 40 projects from the back end of the insulator 10. The leg 43 of the terminal nut 40 is inserted into the penetration hole 12 in the insulator 10. A plug cap to which a high-voltage cable (not shown) is connected is fitted to the cap attachment portion 41, and a high voltage is applied to cause spark discharge.

In the penetration hole 12 in the insulator 10, a resistor 70 for reducing radio-frequency noise during spark generation is disposed between the front end of the terminal nut 40 (front end of the leg 43) and the back end of the center electrode 20 (back end of the head 211). The resistor 70 is formed of a composition containing, for example, glass particles serving as a main component, ceramic particles formed of a material other than glass, and a conductive material. In the penetration hole 12, the gap between the resistor 70 and the center electrode 20 is filled with a conductive seal 60. The gap between the resistor 70 and the terminal nut 40 is filled with a conductive seal 80. The conductive seals 60 and 80 are formed of, for example, a composition containing glass particles such as $B_2O_3$—$SiO_2$-based glass particles, and metal particles (such as Cu or Fe particles).

A-2. Structure of Front-End Portion of Center Electrode

Figure 2A:
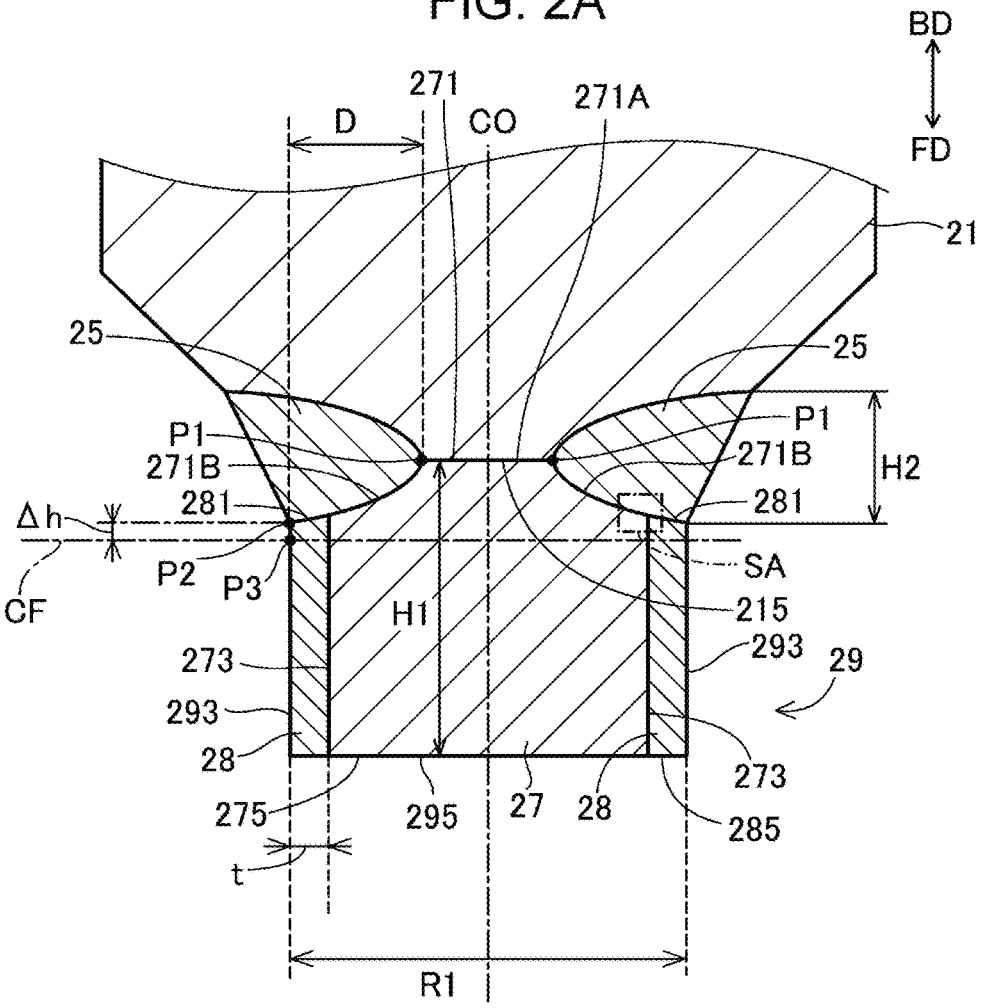
FIGS. 2A and 2B are views illustrating a structure around a front end of a center electrode 20.
Figure 2B:
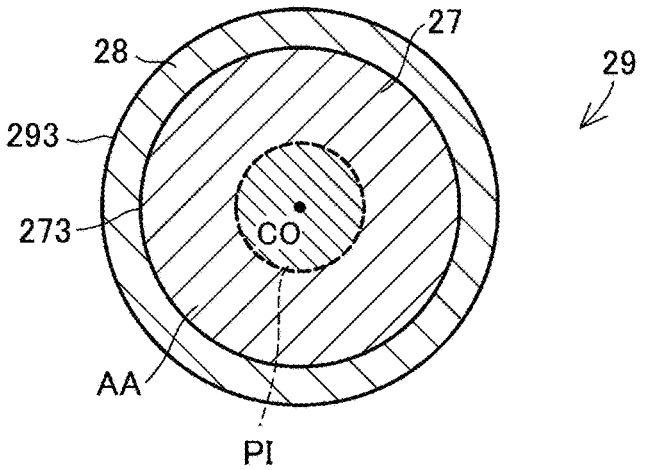

FIGS. 2A and 2B are views illustrating a structure around a front end of a center electrode 20. FIG. 2A is a sectional view of a spark plug 100 and a center electrode tip 29 taken along a plane including an axial line CO. The center electrode tip 29 has a substantially cylindrical shape and has the first discharge surface 295 described above and a side surface 293 that intersects the first discharge surface 295. A diameter R1 of the center electrode tip 29 is, for example, preferably 0.2 mm or more, and more preferably 0.4 mm or more but is not limited thereto. The diameter R1 of the center electrode tip 29 is preferably 1.5 mm or less, and more preferably 1.0 mm or less.

The center electrode tip 29 includes a tip body 27 and a cover layer 28 that forms the side surface 293 of the center electrode tip 29. The tip body 27 has a substantially cylindrical shape and has a front surface 275 that forms a part of the first discharge surface 295, an opposite surface 271 (back surface) disposed on the opposite side of the first discharge surface 295, and a side surface 273 extending in a direction that intersects the first discharge surface 295 (in the axial line direction in the present embodiment). The tip body 27 is formed of Ir or an alloy containing Ir as a main component (hereinafter, may be simply referred to as an "Ir alloy"). The phrase "containing Ir as a main component" means that the content (unit: % by weight) of Ir is the highest. The alloy that forms the tip body 27 preferably has an Ir content of 50% by weight or more. The alloy that forms the tip body 27 may contain at least one other component selected from, for example, ruthenium (Ru), Ni, rhodium (Rh), Pt, and aluminum (Al).

In the present embodiment, the cover layer 28 covers the side surface 273 of the tip body 27 and does not cover the front surface 275 or the opposite surface 271 of the tip body 27. A front surface 285 of the cover layer 28 forms a part of the first discharge surface 295. An opposite surface 281 of the cover layer 28, the opposite surface 281 being disposed on the opposite side of the first discharge surface 295, is in contact with a welded portion 25 described below. A thickness t of the cover layer 28 is, for example, 50 μm or less. The thickness t of the cover layer 28 is preferably 2 μm or more.

Figure 3:
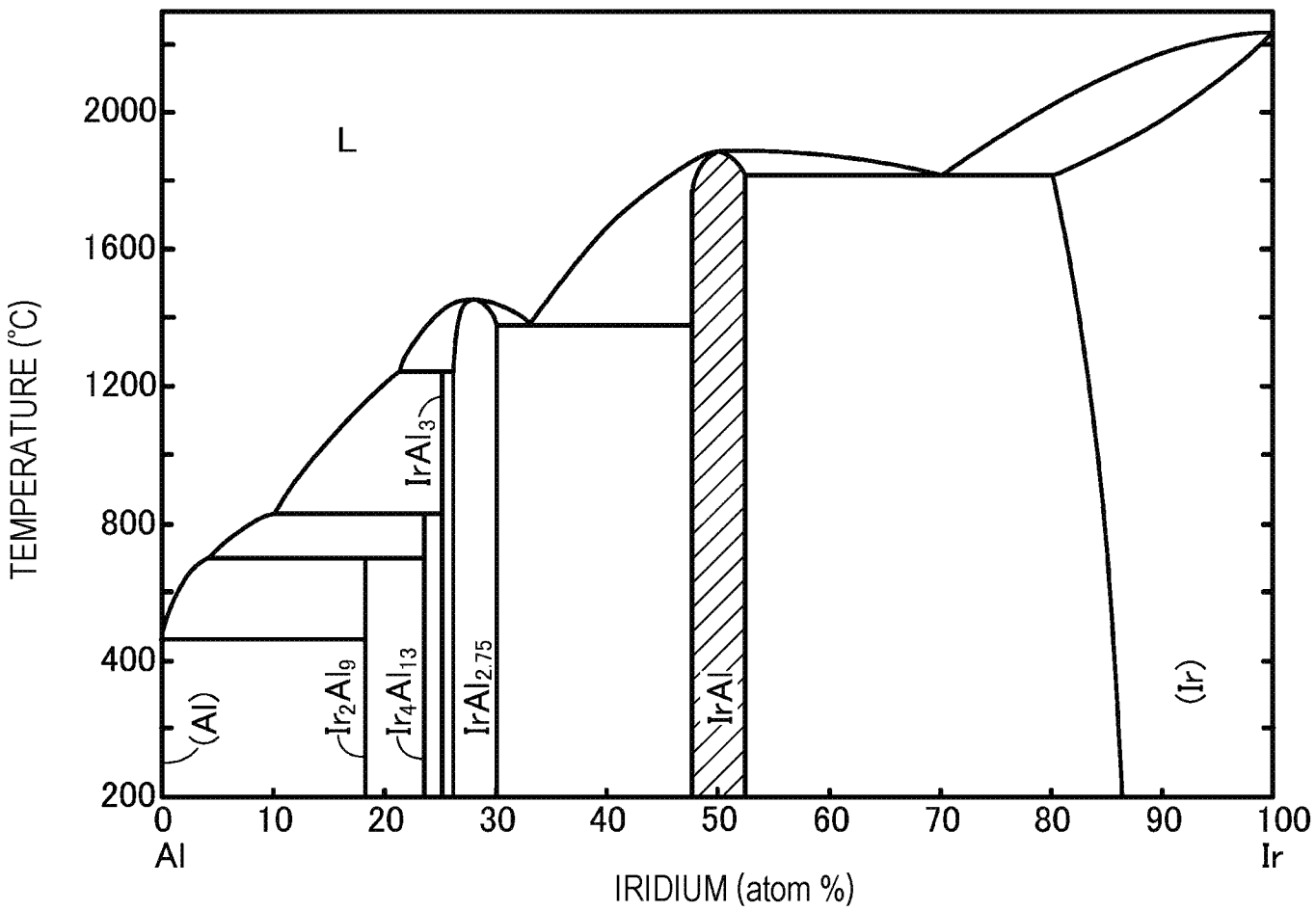
FIG. 3 is a binary phase diagram of Ir—Al.

The cover layer 28 is formed of an IrAl intermetallic compound, which is an intermetallic compound of Ir and Al. The cover layer 28 (IrAl intermetallic compound) has a crystal structure specified by a space group of Pm3m and a space group number of 221. FIG. 3 is a binary phase diagram of Ir—Al. Iridium-aluminum (IrAl) intermetallic compounds are formed in an equilibrium state in the ranges of the composition (where the ratio of Al to Ir is about 47.5 to 52.5 atomic percent) and the temperature (about 2,000° C. or less) shown by the hatched area in FIG. 3. The cover layer 28 may contain an Ir solid solution or $Al_2O_3$. The IrAl intermetallic compounds may contain, in addition to Ir and Al, at least one component, for example, selected from components contained in the alloy that forms the tip body 27, such as Ni, Ru, Rh, and Pt, and impurities within a range in which the crystal structure is maintained.

The center electrode tip 29 before being bonded to the center electrode body 21 is prepared by covering a base formed of Ir or an Ir alloy with an IrAl intermetallic compound by an aluminizing process. The aluminizing process is a process for generating an Al compound on a surface of a base by placing the base and a reducing agent in an alloy powder containing Al, and maintaining the base at a predetermined holding temperature (for example, 800° C. to 1,300° C.) for a predetermined holding time (for example, 2 to 6 hours). Specifically, a powder including three powders, namely, (1) an Al alloy powder for reducing the activity of Al, (2) an alumina powder for controlling rapid proceeding of a reaction between an electrode tip and the Al alloy powder, and (3) an activator powder that activates Al in the Al alloy powder to generate a gas-phase chloride of Al is used in the process. An example of the Al alloy powder is a powder containing at least one of Fe, Ni, and Cr. The activator powder is suitably formed of a chloride of ammonia or chloride of a metal such as Na, Cr, or Ag which accelerates the generation of a chloride of Al. A base formed of an Ir alloy is embedded in a powder prepared by mixing an Al alloy powder, an alumina powder in the same amount as that of the Al alloy powder, and an $NH_4Cl$ powder serving as an activator powder and maintained at a predetermined holding temperature for a predetermined holding time. As a result, the surface of the Ir alloy base can be covered with an IrAl intermetallic compound. The thickness of the cover layer formed of the IrAl intermetallic compound can be controlled by adjusting conditions such as the content of Al in the Al alloy powder, the holding temperature, and the holding time. With an increase in the content of Al, an increase in the holding temperature, and an increase in the holding time, the thickness of the cover layer formed of the IrAl intermetallic compound increases. For example, Japanese Unexamined Patent Application Publication No. 2014-55325 and International Publication No. 2012/033160 disclose the details of the aluminizing process.

In the present embodiment, the center electrode tip 29 is prepared by forming a cover layer 28 on a surface of a wire rod used as a base, and subsequently cutting the wire rod. As a result, a center electrode tip 29 whose side surface is covered with the cover layer 28 and whose end faces (the first discharge surface 295 and the opposite surface) are not covered with the cover layer 28 can be prepared.

The center electrode tip 29 is bonded to the center electrode body 21 by laser welding. Therefore, the welded portion 25 formed by the laser welding is disposed between the center electrode tip 29 and the center electrode body 21. The welded portion 25 is a portion in which a part of the center electrode tip 29 and a part of the center electrode body 21 before welding are melted and solidified. Accordingly, the welded portion 25 contains a component of the center electrode tip 29 and a component of the center electrode body 21. The welded portion 25 is a bonding portion that bonds the center electrode tip 29 and the center electrode body 21 and is also a bead that bonds the center electrode tip 29 and the center electrode body 21. Examples of the laser used in the laser welding include YAG lasers and fiber lasers, which have a high degree of freedom of the shape of a welded portion to be formed because fiber lasers have a higher light-collecting ability than YAG lasers.

The welded portion 25 is formed on the side surface 293 of the center electrode tip 29 and between the center electrode body 21 and the center electrode tip 29 so as to extend over the entire periphery in the circumferential direction. An inner end P1 of the welded portion 25 in the radial direction does not reach the axial line CO. Specifically, a welding depth D (the length from the side surface 293 to the inner end P1 of the welded portion 25 in the radial direction) is smaller than the radius (R1/2) of the center electrode tip 29 (D<(R1/2)). Therefore, the opposite surface 271 of the tip body 27 includes a non-contact portion 271A and a contact portion 271B. The non-contact portion 271A is a portion that is not in contact with the welded portion 25 and corresponds to the central portion that intersects the axial line CO in FIG. 2A. In the present embodiment, the non-contact portion 271A is in direct contact with a front-end face 215 of the center electrode body 21. The contact portion 271B is a portion outside the non-contact portion 271A in the radial direction and is in contact with the welded portion 25.

FIG. 2B illustrates a particular section CF formed by cutting the center electrode tip 29 along a plane that is located near a boundary between the welded portion 25 and the center electrode tip 29, that is parallel to the first discharge surface 295, that intersects the center electrode tip 29, and that does not intersect the welded portion 25. The one-dotted chain line in FIG. 2A indicates the particular section CF. More exactly, the particular section CF is a plane that intersects a point P3 and is perpendicular to the axial line CO, the point P3 being 30 μm away in the axial line direction from an end (that is, an end on the center electrode tip 29 side) P2 of the boundary between the center electrode tip 29 and the welded portion 25 on the side surface of the welded portion 25 and the center electrode tip 29, the end P2 being disposed in the forward direction FD (Δh=30 μm).

On the particular section CF in FIG. 2B, the tip body 27 and the cover layer 28 appear and the non-contact portion 271A does not appear. The broken line in FIG. 2B indicates a projection image PI that projects the non-contact portion 271A on the particular section CF in a direction perpendicular to the first discharge surface 295, that is, in the axial line direction. For the sake of ease of understanding, in FIG. 2B, the cover layer 28, the projection image PI, and a portion AA of the tip body 27 excluding the projection image PI are indicated by different hatching patterns.

On the particular section CF, the area of the tip body 27 is represented by Sa, the area of the projection image PI of the non-contact portion 271A is represented by Sb, and the area of the portion AA of the tip body 27 excluding the projection image PI is represented by Sx. The area Sx of the portion AA is determined by subtracting the area Sb of the projection image PI of the non-contact portion 271A from the area Sa of the tip body 27 (Sx=(Sa−Sb)). The area Sx of the portion AA can be defined as an area of a bonding portion of the tip body 27, the bonding portion being bonded to the center electrode body 21 with the welded portion 25 therebetween. The area Sx of the portion AA can also be defined as a projection area determined by projecting the contact portion 271B on the particular section CF in the axial line direction.

In the present embodiment, on the particular section CF, the area (Sa−Sb) of the portion AA corresponds to 35% or more of the area Sa of the tip body 27 ({(Sa−Sb)/Sa}×100≥35). As a result, the tip body 27 and the center electrode body 21 can be bonded to each other by the welded portion 25 on a sufficiently large area. Consequently, the bonding strength between the center electrode tip 29 and the center electrode body 21 can be improve to improve separation resistance of the center electrode tip 29. The value represented by {(Sa−Sb)/Sa}×100 is hereinafter referred to as an "area ratio A".

Figure 4A:
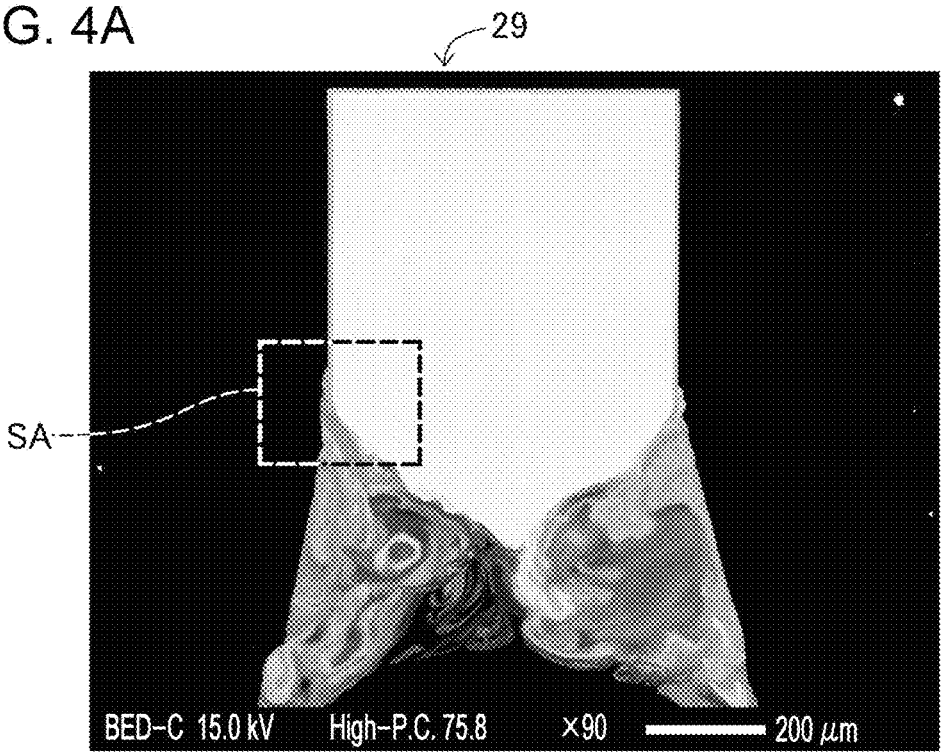
FIGS. 4A and 4B are sectional images around a center electrode tip 29.
Figure 4B:
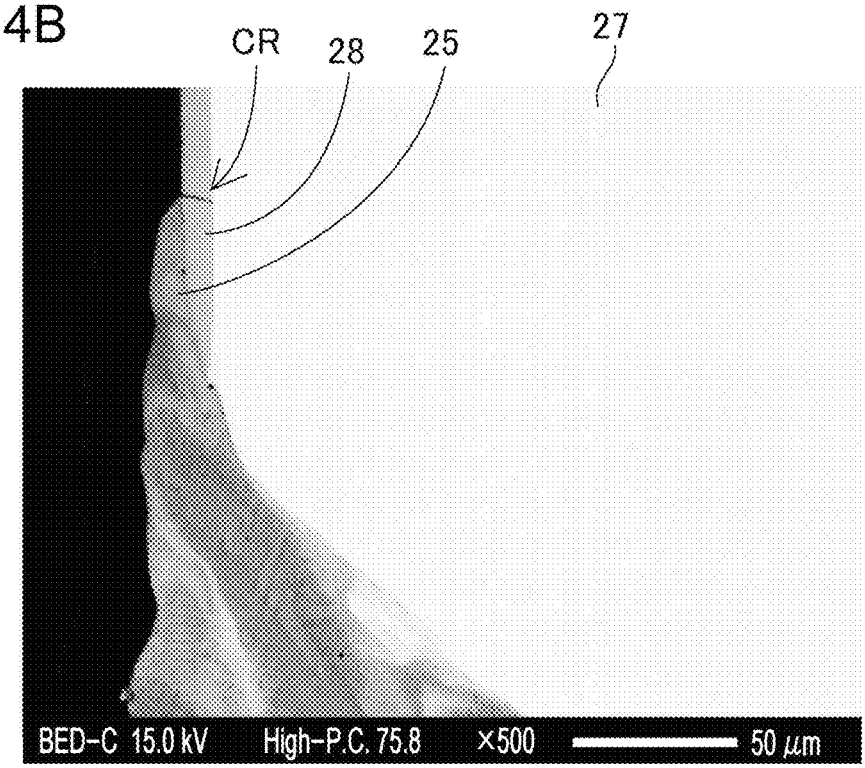

More specifically, IrAl intermetallic compounds are hard and brittle and thus are unlikely to deform as compared with Ir and Ir alloys. Therefore, when thermal stress is generated between the cover layer 28 formed of an IrAl intermetallic compound and the welded portion 25 at a high temperature, separation due to a crack or the like may occur between the cover layer 28 and the welded portion 25 in an early stage. FIGS. 4A and 4B are sectional images around the center electrode tip 29. FIG. 4B shows an enlarged sectional image of region SA in FIG. 4A. The sectional images of FIGS. 4A and 4B are images taken by using a field emission scanning electron microscope (FE-SEM). In the image of FIG. 4B, a crack CR extending in the radial direction is generated near a boundary between the cover layer 28 and the welded portion 25. When such a crack CR is generated, the cracked portion does not contribute to bonding between the center electrode tip 29 and the center electrode body 21. Accordingly, even if the contact area between the opposite surface 281 of the cover layer 28 and the welded portion 25 is increased, the increase in the contact area hardly contributes to an improvement in separation resistance between the center electrode tip 29 and the center electrode body 21. In addition, since Al is mixed in the welded portion 25, the welded portion 25 is also hard and brittle compared with the case where the cover layer 28 is not provided or a cover layer formed of Pt is provided, and is unlikely to deform. Therefore, the bonding strength between the center electrode tip 29 and the center electrode body 21 easily decreases. In order to improve separation resistance between the center electrode tip 29 and the center electrode body 21, it is important to ensure the area of the contact portion 271B of the tip body 27 formed of Ir or an Ir alloy, the contact portion 271B being in contact with the welded portion 25. On the particular section CF, when the area (Sa−Sb) of the portion AA corresponds to 35% or more of the area Sa of the tip body 27, that is, when the area ratio A is 35% or more, the area of the contact portion 271B relative to the tip body 27 can be sufficiently ensured. Thus, the bonding strength between the center electrode tip 29 and the center electrode body 21 can be improved to improve separation resistance of the center electrode tip 29.

Furthermore, in the present embodiment, the area ratio A is preferably 45.7% or more. In this case, the tip body 27 and the center electrode body 21 can be bonded to each other by the welded portion 25 on a larger area to further improve the bonding strength between the center electrode tip 29 and the center electrode body 21. As a result, separation resistance of the center electrode tip 29 can be further improved.

In the present embodiment, when the area of an exposed portion of surfaces of the center electrode tip 29 is represented by Sc, the area (Sa−Sb) of the portion AA preferably corresponds to 7% or more of the area Sc. In the example illustrated in FIGS. 2A and 2B, among the surfaces of the center electrode tip 29, the exposed portion includes the first discharge surface 295 and the side surface 293 and does not include the opposite surfaces 271 and 281, which are in contact with the welded portion 25 and the center electrode body 21. Accordingly, the area Sc of the exposed portion is the sum of the area of the first discharge surface 295 and the area of the side surface 293.

The area Sc of the exposed portion is an area (heat-receiving area) of a portion of the center electrode tip 29, the portion being exposed to combustible gas and receiving heat during use. When the area (Sa−Sb) of the portion AA corresponds to 7% or more of the area Sc, the tip body 27 and the center electrode body 21 can be bonded to each other on a sufficiently large area with respect to the area Sc of the portion that receives heat. As a result, the bonding strength between the tip body 27 and the center electrode body 21 can be improved to further improve separation resistance of the center electrode tip 29. The value represented by {(Sa−Sb)/Sc}×100 is hereinafter referred to as an "area ratio B".

More specifically, the surface (opposite surface 281) of the cover layer 28, the surface being in contact with the welded portion 25, hardly contributes to bonding, and thus almost all the surface (opposite surface 281) of the cover layer 28 has been separated in early use. Therefore, heat received by the exposed portion of the center electrode tip 29 transfers to the center electrode body 21 through the area (Sa−Sb) of the bonding portion AA that substantially contributes to the bonding. Accordingly, in the case where the cover layer 28 is provided, a ratio of the area that substantially contributes to bonding relative to the heat-receiving area tends to decrease compared with the case where the cover layer 28 is not provided or a cover layer formed of Pt is provided, and thus overheating easily occurs. As a result, separation resistance tends to decrease. Therefore, it is important that the ratio (area ratio B) of the area (Sa−Sb) of the bonding portion AA to the area Sc be sufficiently high. When the area ratio B is 7% or more, the area (Sa−Sb) of the bonding portion AA to the surface area Sc can be sufficiently ensured. Thus, the bonding strength between the center electrode tip 29 and the center electrode body 21 can be further improved to further improve separation resistance of the center electrode tip 29.

The method for measuring the areas Sa and Sb will be described. Two spark plugs 100 of the same type are prepared as samples. A particular section CF of a center electrode tip 29 of one of the samples is mirror-polished. For the particular section CF, capturing of a mapping image of an Al component, and quantification and structural analysis of an Al component are performed to specify an IrAl intermetallic compound (that is, the cover layer 28) on the particular section CF. The formation of a mapping image and the quantification are performed by using, for example, a field-emission electron probe microanalyzer (FE-SPMA), specifically, using a wavelength-dispersive X-ray spectrometer (WDS) attached to JXA-8500F manufactured by JEOL Ltd. The structural analysis is performed by using an X-ray diffractometer (XRD), specifically, using a micro-area X-ray diffractometer RINT1500 manufactured by Rigaku Corporation. When the cover layer 28 has a small thickness and it is difficult to perform the specification by using the structural analysis, analysis may be performed on the side surface 293 of the center electrode tip 29 instead of the particular section CF. The thickness of the specified cover layer 28 is then measured.

Subsequently, an image of a particular section CF of the other sample is captured by using a micro-CT scanner (specifically, TOSCANER-32250μhd manufactured by Toshiba IT & Control Systems Corporation). In the captured image, a threshold of the color tone of the captured image is adjusted such that the thickness of the cover layer 28 becomes the same as the thickness of the cover layer 28 measured on the mirror surface described above. On the captured image of the particular section CF, the outer edge of the cover layer 28 and the boundary between the tip body 27 and the cover layer 28 in FIG. 2B appear.

Next, an image of a section perpendicular to the axial line CO and passing through the non-contact portion 271A in FIG. 2A is captured by using a micro-CT scanner. On the captured image of the section passing through the non-contact portion 271A, the boundary between the non-contact portion 271A and the welded portion 25, that is, the outer edge of the projection image PI in FIG. 2B appears.

The areas Sa and Sb described above are calculated on the captured image of the particular section CF and the captured image passing through the non-contact portion 271A by using an image processing program.

When it is difficult to calculate the areas Sa and Sb with images captured by a micro-CT scanner as in the case where the cover layer 28 has an extremely small thickness t, after a center electrode tip 29 of one sample is mirror-polished and a particular section CF is observed, the sample may then be further polished, and a section passing through the non-contact portion 271A may be observed to calculate the areas Sa and Sb.

Next, the method for measuring the area Sc will be described. In the measurement of the area Sc, an area Sz1 of the first discharge surface 295 of the center electrode tip 29 is determined by using the CT scanner or a charge-coupled device (CCD) camera. In addition, an area Sz2 of the side surface 293 intersecting the first discharge surface 295 is measured as follows. A total length (hereinafter referred to as a "perimeter Lz") of the outer periphery of the particular section CF (FIG. 2B) is measured by using the CT scanner or a CCD camera. In the case where a CCD camera is used, the center electrode tip 29 is mirror-polished and the particular section CF is observed. Next, the appearance is observed over the entire periphery of the side surface 293 intersecting the first discharge surface 295. In this observation, with respect to the distance between the first discharge surface 295 and an end P2 of the boundary between the center electrode tip 29 and the welded portion 25 in the forward direction FD on the side surface of the welded portion 25 and the center electrode tip 29, the shortest distance Hz on the entire periphery is specified. Next, the area Sz2 of the side surface 293 is calculated as (Lz×Hz). The area Sc is calculated by using a formula Sc=Sz1+Sz2.

Figure 5:
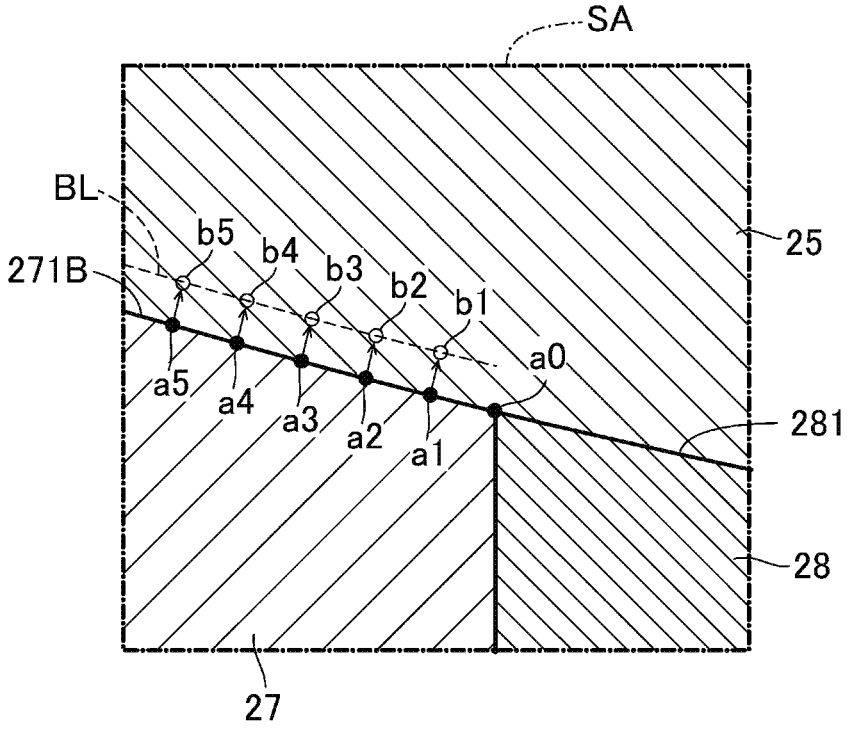
FIG. 5 is an enlarged view of region SA in FIG. 2A.

FIG. 5 is an enlarged view of region SA in FIG. 2A. In the present embodiment, a content of Al in the welded portion 25 in a vicinity of the boundary between the tip body 27 and the welded portion 25 (hereinafter may be referred to as a "boundary Al concentration") is preferably 10% by mass or less. With an increase in the content of Al in the welded portion 25, the welded portion 25 becomes unlikely to deform and tends to become brittle. With the above structure, separation resistance of the center electrode tip 29 can be further improved by suppressing the welded portion 25 from becoming unlikely to deform and tending to become brittle in the vicinity of the boundary between the tip body 27 and the welded portion 25.

In the present embodiment, furthermore, the boundary Al concentration is particularly preferably 5% by mass or less. This structure further suppresses a phenomenon that the welded portion 25 is unlikely to deform and becomes brittle in the vicinity of the boundary between the tip body 27 and the welded portion 25. Thus, separation resistance of the center electrode tip 29 can be particularly improved.

Herein, the term "vicinity of the boundary between the tip body 27 and the welded portion 25" refers to, for example, as illustrated in FIG. 5, positions BL 20 μm away from a boundary between the tip body 27 and the welded portion 25 (that is, the contact portion 271B) within the welded portion 25 in a direction perpendicular to the boundary.

The method for measuring the boundary Al concentration will be described. A sample is prepared by cutting a portion including the center electrode tip 29, the welded portion 25, and the center electrode body 21 along a plane including the axial line CO, and polishing the resulting section to form a mirror-polished surface. On the mirror-polished surface, point a0 shown in FIG. 5, that is, intersection point a0 between the boundary between the tip body 27 and the welded portion 25 (the contact portion 271B) and the boundary between the cover layer 28 and the tip body 27 is specified. Reference points are sequentially determined at intervals of 30 μm from intersection point a0 toward the axial line CO along the boundary between the tip body 27 and the welded portion 25. Although only reference points al to a5 are shown in FIG. 5, the reference points are present so as to extend to point P1 in FIG. 2A, that is, extend to an end of the boundary between the tip body 27 and the welded portion 25 on the axial line CO side. Points (for example, points b1 to b5 in FIG. 5) located at positions shifted by 20 μm from the corresponding reference points within the welded portion 25 in a direction perpendicular to the boundary between the tip body 27 and the welded portion 25 are specified as measuring points. The content of Al is measured at each of the measuring points, and the average of the measured contents of Al is calculated as the boundary Al concentration. The content of Al at each of the measuring points is measured by using the WDS at an acceleration voltage of 20 kV and with a spot diameter of 10 μm.

B. Second Embodiment

Figure 6A:
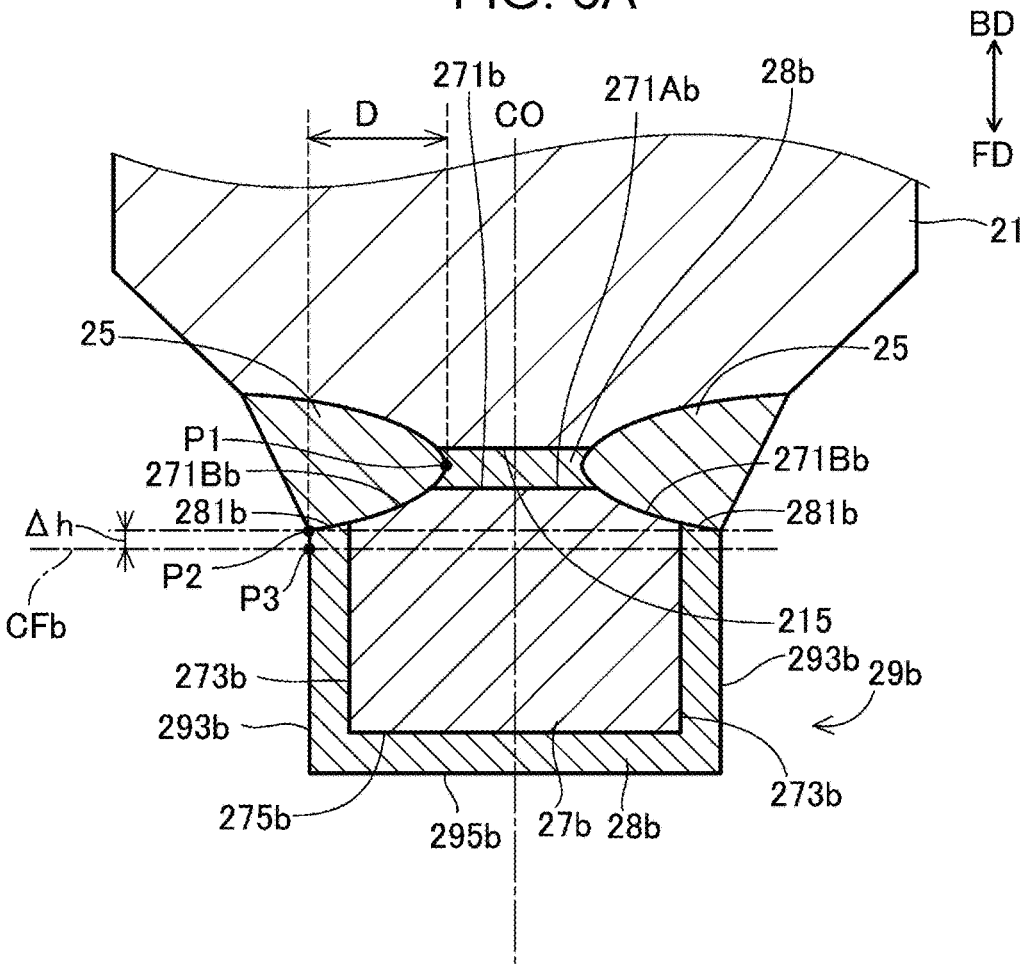
FIGS. 6A and 6B are views illustrating a structure around a front end of a center electrode of a second embodiment.
Figure 6B:
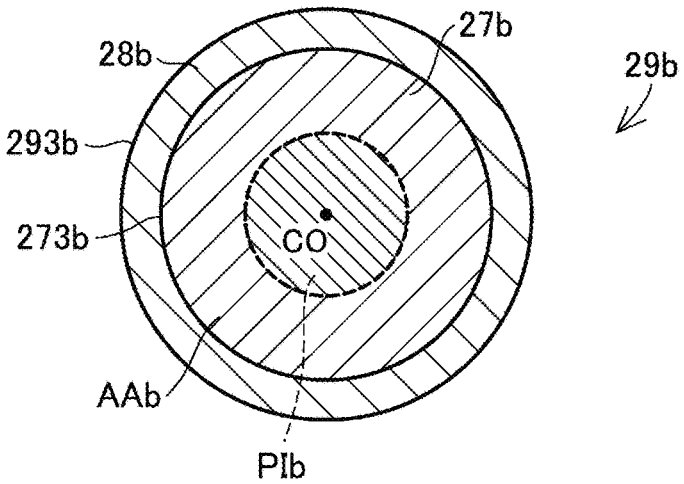

FIGS. 6A and 6B are views illustrating a structure around a front end of a center electrode of a second embodiment. FIG. 6A is a sectional view of a portion around a front end of a center electrode taken along a plane including an axial line CO. In the second embodiment, a center electrode tip 29*b* is used instead of the center electrode tip 29 of the first embodiment. In this center electrode tip 29*b*, a side surface 273*b* of a tip body 27*b*, a surface (front surface) 275*b* on the first discharge surface 295*b* side, and an opposite surface 271*b* disposed on the opposite side of the first discharge surface 295*b* are covered with a cover layer 28*b*. Therefore, in the second embodiment, in addition to the side surface 293*b* of the center electrode tip 29*b*, the first discharge surface 295*b* is also formed by the cover layer 28*b*. This center electrode tip 29*b* can be prepared by forming an IrAl intermetallic compound film, by the aluminizing process, on a base prepared in advance so as to have a columnar shape of the tip body 27*b*.

A non-contact portion 271Ab of the opposite surface 271*b* of the tip body 27*b*, the non-contact portion 271Ab being not in contact with the welded portion 25, is in contact, not with a center electrode body 21, but with the cover layer 28*b*. A contact portion 271Bb of the opposite surface 271*b*, the contact portion 271Bb being disposed outside the non-contact portion 271Ab, is in contact with the welded portion 25, as in the first embodiment, because the cover layer 28*b* is melted by laser welding. An opposite surface 281*b* of the cover layer 28*b* formed on the side surface is in contact with the welded portion 25, as in the first embodiment. Other structures are the same as those of the first embodiment.

FIG. 6B illustrates a particular section CFb formed by cutting the center electrode tip 29*b* at the same position as that in FIG. 2B. A sectional view of a portion around the front end of the center electrode taken along a plane including the axial line CO is shown. As in FIG. 2B, the broken line in FIG. 6B indicates a projection image PIb that projects the non-contact portion 271Ab on the particular section CFb in a direction perpendicular to the first discharge surface 295*b*, that is, in the axial line direction.

In the second embodiment, on the particular section CFb, the area of the tip body 27*b* is represented by Sa, the area of the projection image PIb of the non-contact portion 271Ab is represented by Sb, and a portion AAb of the tip body 27*b* excluding the projection image PIb is represented by Sx, as in the first embodiment. In this case, the area Sx of the portion AAb is represented by a formula Sx=(Sa−Sb). The area (Sa−Sb) of the portion AAb corresponds to 35% or more of the area Sa of the tip body 27*b*. That is, the area ratio A is 35% or more. As a result, the bonding strength between the center electrode tip 29*b* and the center electrode body 21 can be improved to improve separation resistance of the center electrode tip 29*b*. The area (Sa−Sb) of the portion AAb preferably corresponds to 45.7% or more of the area Sa of the tip body 27*b*.

Furthermore, in the second embodiment, when the area of an exposed portion of surfaces of the center electrode tip 29*b* is represented by Sc, the area (Sa−Sb) of the portion AAb preferably corresponds to 7% or more of the area Sc, as in the first embodiment. That is, the area ratio B is preferably 7% or more. As a result, the bonding strength between the center electrode tip 29*b* and the center electrode body 21 can be improved to further improve separation resistance of the center electrode tip 29*b*. In the second embodiment, the boundary Al concentration of the welded portion 25*b* is preferably 10% by mass or less. As a result, separation resistance of the center electrode tip 29*b* can be further improved. The boundary Al concentration of the welded portion 25*b* is more preferably 5% by mass or less. As a result, separation resistance of the center electrode tip 29*b* can be particularly improved.

C. Third Embodiment

Figure 7:
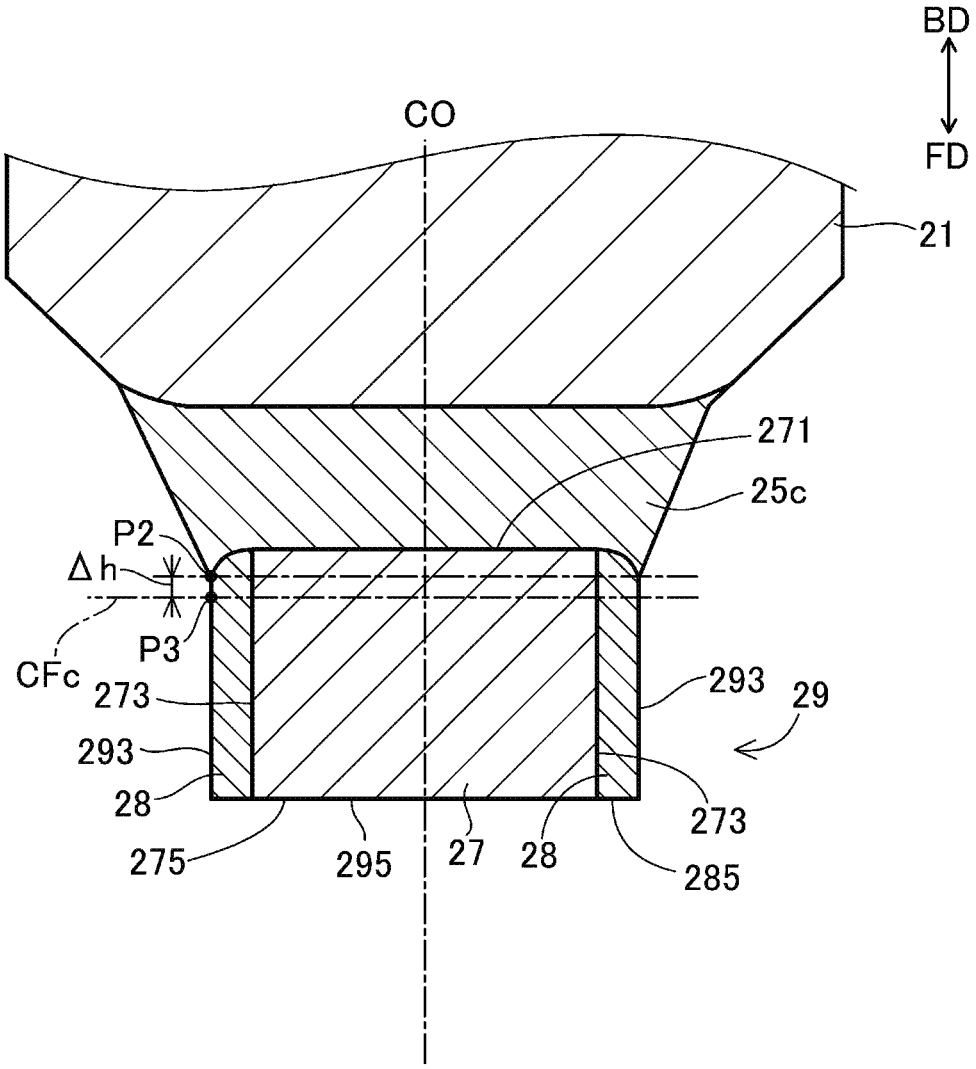
FIG. 7 is a sectional view of a structure around a front end of a center electrode of a third embodiment.

FIG. 7 illustrates a sectional view of a portion around a front end of a center electrode of a third embodiment taken along a plane including an axial line CO. Unlike the first embodiment, since the welding depth D in the third embodiment is sufficiently large, a welded portion 25*c* reaches a position intersecting the axial line CO. Therefore, the welded portion 25*c* has, for example, a substantially columnar shape. The entire opposite surface 271 of a center electrode tip 29 forms a contact portion that is in contact with the welded portion 25*c*, and a non-contact portion that is not in contact with the welded portion 25*c* is not present. Other structures are the same as those of the first embodiment.

In the third embodiment, since a non-contact portion is not present, a projection image to be projected on a particular section CFc is also not present. Therefore, in the third embodiment, the area Sb of the projection image of the non-contact portion is zero. Consequently, the area ratio A is 100%. The area ratio B is a ratio of the area Sa of the tip body 27 to the area Sc of an exposed portion of surfaces of the center electrode tip 29 (area ratio B (%)=(Sa/Sc)×100).

D. First Evaluation Test

In a first evaluation test, as shown in Table 1, nineteen types of Samples 1 to 19 were prepared in which at least one of a material of a cover layer, a thickness t of the cover layer, the type of laser used in laser welding, an irradiation position of a laser, and a welding depth D was different from each other. Samples 5 to 7, 9 to 12, and 14 to 19 are samples of embodiments. Samples 1 to 4, 8, and 13 are samples for comparison. The term "irradiation position of a laser" refers to a central position of a region in the axial line direction, the region being irradiated with a laser, where a position at the boundary between a center electrode tip and a center electrode body in the axial line direction is defined as a reference (0), the center electrode tip side is defined as positive, and the center electrode body side is defined as negative. Table 1 shows the parameters and the measurement results of the area ratios A and B of the samples.

TABLE 1

| Sample No. | Cover layer | Cover layer thickness (mm) | Type of laser | Irradiation position (mm) | Welding depth (mm) | Area ratio B (%) | Area ratio A (%) | Separation resistance |
|---|---|---|---|---|---|---|---|---|
| 1 | — | — | YAG | 0.05 | 0.06 | 5.8% | 27.8% | B |
| 2 | Pt | 0.025 | YAG | 0.05 | 0.06 | 2.7% | 14.0% | B |
| 3 | Pt | 0.1 | YAG | 0.05 | 0.08 | 0.0% | 0.0% | A |
| 4 | IrAl | 0.003 | YAG | 0.05 | 0.045 | 5.2% | 26.3% | C |
| 5 | IrAl | 0.003 | YAG | 0.05 | 0.06 | 7.3% | 35.1% | A |

TABLE 1-continued

| Sample No. | Cover layer | Cover layer thickness (mm) | Type of laser | Irradiation position (mm) | Welding depth (mm) | Area ratio B (%) | Area ratio A (%) | Separation resistance |
|---|---|---|---|---|---|---|---|---|
| 6 | IrAl | 0.003 | YAG | 0.05 | 0.09 | 10.6% | 50.0% | S |
| 7 | IrAl | 0.01 | YAG | 0.05 | 0.25 | 20.7% | 97.0% | S |
| 8 | IrAl | 0.015 | YAG | 0.05 | 0.05 | 4.4% | 23.1% | C |
| 9 | IrAl | 0.015 | YAG | 0.05 | 0.07 | 7.0% | 35.0% | A |
| 10 | IrAl | 0.015 | YAG | 0.05 | 0.09 | 8.3% | 45.7% | S |
| 11 | IrAl | 0.015 | YAG | 0.05 | 0.3 | 21.6% | 100.0% | S |
| 12 | IrAl | 0.02 | YAG | 0.05 | 0.075 | 6.5% | 35.4% | B |
| 13 | IrAl | 0.025 | YAG | 0.05 | 0.07 | 5.5% | 30.0% | C |
| 14 | IrAl | 0.025 | YAG | 0.05 | 0.1 | 8.3% | 36.0% | A |
| 15 | IrAl | 0.01 | FL | 0.02 | 0.25 | 16.7% | 97.7% | S |
| 16 | IrAl | 0.015 | FL | 0.02 | 0.3 | 18.6% | 100.0% | S |
| 17 | IrAl | 0.01 | YAG | 0.01 | 0.25 | 18.7% | 98.5% | S |
| 18 | IrAl | 0.025 | YAG | 0.01 | 0.1 | 7.7% | 37.5% | A |
| 19 | IrAl | 0.01 | YAG | 0.08 | 0.25 | 21.1% | 96.2% | S |

Items common to the samples are as follows.

Material of center electrode body: INC600

Diameter R1 of center electrode tip: 0.6 mm

Width H1 (height) of center electrode tip in axial line direction: 0.8 mm

Material of tip body: an alloy having an Ir content of 68% by weight, a Ru content of 11% by weight, a Rh content of 20% by weight, and a Ni content of 1% by weight.

In Sample 1, the center electrode tip included no cover layer. In Samples 2 to 19, as in the center electrode tip 29 (FIGS. 2A and 2B) of the first embodiment, a cover layer was formed so that the cover layer was provided only on the side surface of the tip body and was not provided on end faces of the tip body. The thickness t of the cover layer of each of Samples 2 to 19 was any of 0.003 mm, 0.01 mm, 0.015 mm, 0.02 mm, 0.025 mm, and 0.1 mm.

In Samples 2 and 3, a cover layer formed of Pt was formed on the center electrode tip. The cover layer formed of Pt was formed by a known plating process. In Samples 4 to 19, a cover layer formed of an IrAl intermetallic compound was formed on the center electrode tip by the aluminizing process.

The welding depth D of each of Samples 1 to 19 was any of 0.045 mm, 0.05 mm, 0.06 mm, 0.07 mm, 0.075 mm, 0.08 mm, 0.09 mm, 0.1 mm, 0.25 mm, and 0.3 mm. Note that a welding depth D of 0.3 mm means that, as in the third embodiment in FIG. 7, the non-contact portion 271A is not present because the welding depth D is large. Therefore, Samples 11 and 16, in which the welding depth D is 0.3 mm, each have an area ratio A of 100%. In Sample 3, since the welding depth D (0.08 mm) is smaller than the thickness t (0.1 mm) of the cover layer, the welded portion does not reach the tip body ((Sa−Sb)=0). Accordingly, the area ratio A and the area ratio B are each 0%.

In Samples 1 to 14 and 17 to 19, a YAG laser was used in the laser welding. In Samples 15 and 16, a fiber laser (denoted by FL in Table 1) was used in the laser welding. In the samples prepared by using the YAG laser, the length H2 (refer to FIG. 2A) of the welded portion on the side surface in the axial line direction was in the range of 0.1 to 0.6 mm depending on the welding depth D. In the samples prepared by using the fiber laser, the length H2 (refer to FIG. 2A) was in the range of 0.15 to 0.4 mm depending on the welding depth D.

The irradiation position of the laser was any of 0.05 mm, 0.01 mm, 0.02 mm, and 0.08 mm from the boundary between the center electrode tip and the center electrode body toward the center electrode tip side.

In the first evaluation test, two samples were prepared for each type of samples. The area ratios A and B were measured by the methods described above using one of the two samples of the same type. An actual-engine thermal cyclic test described below was conducted using the other sample. An internal combustion engine mounting each sample was operated for 100 hours. During the operation, one cycle operation including an idling operation for one minute and a full-throttle operation for one minute was repeated. A four-cylinder gasoline engine with a super-charger, the gasoline engine having a displacement of 2.0 L, was used as the internal combustion engine. The temperature at a position 1 mm from the front end of the spark plug toward the front end side was about 750° C. at the maximum.

A sample from which the center electrode tip was not detached at the time when 100 hours passed was evaluated as "S". A sample from which the center electrode tip was not detached at the time when 75 hours passed but was detached by the time 100 hours passed was evaluated as "A". A sample from which the center electrode tip was not detached at the time when 50 hours passed but was detached by the time 75 hours passed was evaluated as "B". A sample from which the center electrode tip was detached by the time 50 hours passed was evaluated as "C".

Table 1 shows the evaluation results. Sample 1, which did not include a cover layer, was evaluated as "B" though the area ratio A was less than 35% (27.8%). The reason for this is believed to be as follows. Since a cover layer formed of an IrAl intermetallic compound, which has low thermal conductivity, is not present, a decrease in the heat conduction performance or embrittlement due to incorporation of Al does not occur. Accordingly, even though the area ratios A and B are somewhat small, separation resistance can be ensured.

Samples 2 and 3, which included a cover layer formed of Pt, had area ratios A of 14.0% and 0%, respectively, and area ratios B of 2.7% and 0%, respectively. Samples 2 and 3 were evaluated as "B" or higher though the area ratio A was less than 35%. In particular, Sample 3 was evaluated as "A" though the area ratios A and B were each 0%. The reason for this is believed that since a decrease in the heat conduction performance or embrittlement due to incorporation of Al does not occur, and the bonding strength between the cover layer and the welded portion is sufficiently high, separation resistance can be ensured even though the bonding area between the tip body and the welded portion is small or zero.

In contrast, among Samples 4 to 19, which included a cover layer formed of an IrAl intermetallic compound, Samples 4, 8, and 13 respectively had area ratios A of 26.3%, 23.1%, and 30.0%, all of which were less than 35%. These samples were evaluated as "C" regardless of the conditions except for the area ratio A, such as the type of the laser and the irradiation position of the laser.

Among Samples 4 to 19, which included a cover layer formed of an IrAl intermetallic compound, Samples 5 to 7, 9 to 12, and 14 to 19 respectively had area ratios A of 35.1%, 50.0%, 97.0%, 35.0%, 45.7%, 100%, 35.4%, 36.0%, 97.7%, 100%, 98.5%, 37.5%, and 96.2%, all of which were 35% or more. These samples were evaluated as "B" or higher regardless of the conditions except for the area ratio A, such as the type of the laser and the irradiation position of the laser.

Among the samples having an area ratio A of 35% or more, Samples 6, 7, 10, 11, 15 to 17, and 19 each had an area ratio A of 45.7% or more. Samples 5 to 7, 9 to 11, and 14 to 19 respectively had area ratios B of 7.3%, 10.6%, 20.7%, 7.0%, 8.3%, 21.6%, 8.3%, 16.7%, 18.6%, 18.7%, 7.7%, and 21.1%, all of which were 7% or more.

Among the samples having an area ratio A of 35% or more, Sample 12, which had an area ratio B of less than 7% and an area ratio A of 45% or less, was evaluated as "B". In contrast, among the samples having an area ratio A of 35% or more, Samples 5, 9, 14, and 18, which had an area ratio B of 7% or more and an area ratio A of 45% or less, was evaluated as "A". Furthermore, among the samples having an area ratio A of 35% or more, Samples 6, 7, 10, 11, 15 to 17, and 19, which had an area ratio B of 7% or more and an area ratio A of 45.7% or more, were evaluated as "S".

The results of the first evaluation test showed that, in a spark plug including a center electrode tip having a cover layer formed of an IrAl intermetallic compound, when the area ratio A was 35% or more, separation resistance could be improved. The results also showed that, in the spark plug, when the area ratio A was 45.7% or more, separation resistance could be further improved. The results also showed that, in the spark plug, when the area ratio B was 7% or more, separation resistance could be particularly improved.

E. Second Evaluation Test

In a second evaluation test, as shown in Table 2, nine types of Samples 20 to 28 were prepared in which at least one of a material of a center electrode body, a diameter of a center electrode tip (tip diameter) R1, a thickness t of a cover layer, the presence or absence of a cover on end faces, an irradiation position of a laser, and a welding depth D was different from each other.

TABLE 2

| Sample No. | Electrode body | Tip diameter (mm) | Cover layer thickness (mm) | End face cover | Irradiation position (mm) | Welding depth (mm) | Boundary Al concentration (wt %) | Separation resistance |
|---|---|---|---|---|---|---|---|---|
| 20 | INC600 | 0.6 | 0.015 | Present | 0.05 | 0.2 | 1 | A |
| 21 | INC601 | 0.6 | 0.015 | Present | 0.03 | 0.3 | 2 | A |
| 22 | Alloy602 | 0.6 | 0.003 | Absent | 0.1 | 0.2 | 2 | A |
| 23 | INC600 | 0.6 | 0.03 | Present | 0.1 | 0.15 | 3 | A |
| 24 | Alloy602 | 0.6 | 0.03 | Present | 0.05 | 0.3 | 4 | A |
| 25 | Alloy602 | 0.6 | 0.03 | Present | 0.1 | 0.15 | 5 | A |
| 26 | Alloy602 | 0.6 | 0.05 | Present | 0.1 | 0.15 | 8 | B |
| 27 | Alloy602 | 0.4 | 0.04 | Present | 0.1 | 0.15 | 10 | B |
| 28 | Alloy602 | 0.4 | 0.05 | Present | 0.1 | 0.15 | 11 | C |

Items common to the samples are as follows.

Material of cover layer: IrAl intermetallic compound

Width H1 (height) of center electrode tip in axial line direction: 0.8 mm

Material of tip body: an alloy having an Ir content of 68% by weight, a Ru content of ii % by weight, a Rh content of 20% by weight, and a Ni content of 1% by weight.

Type of laser: YAG laser

The material of the center electrode body was any of INC600, INC601, and Alloy602. The diameter R1 of the center electrode tip 29 was any of 0.4 mm and 0.6 mm.

The thickness t of the cover layer and the welding depth D were adjusted to ranges in which the area ratio A was 35% or more and the area ratio B was 7% or more. Specifically, the thickness t of the cover layer was any of 0.015 mm, 0.003 mm, 0.03 mm, 0.04 mm, and 0.05 mm. The welding depth D was any of 0.15 mm, 0.2 mm, and 0.3 mm.

The irradiation position of the laser was any of 0.05 mm, 0.03 mm, and 0.1 mm from the boundary between the center electrode tip and the center electrode body toward the center electrode tip side.

As shown in Table 2, a sample having an end-face cover and a sample that did not have an end-face cover were prepared. The sample having an end-face cover is a sample in which, as in the second embodiment (FIGS. 6A and 6B), a cover layer is formed not only on the side surface of the tip body but also on both end faces of the tip body in the axial line direction. The sample that does not have an end-face cover is a sample in which, as in the first embodiment (FIGS. 2A and 2B), a cover layer is formed only on the side surface of the tip body.

The amount of Al introduced from the cover layer into the welded portion is changed by adjusting these conditions, and thus the boundary Al concentration in the welded portion can be adjusted. For example, with a decrease in the diameter R1 of the center electrode tip 29, the boundary Al concentration tends to be high.

In the second evaluation test, two samples were prepared for each type of samples. The boundary Al concentration was measured by the method described above using one of the two samples of the same type. An actual-engine durability test described below was conducted using the other sample. An internal combustion engine mounting each sample was operated for 100 hours. During the operation, one cycle operation including an idling operation for one minute and a full-throttle operation for one minute was repeated. A four-cylinder gasoline engine with a super-charger, the gasoline engine having a displacement of 2.0 L, was used as the internal combustion engine. The temperature at a position 1 mm from the front end of the spark plug toward the front end side was about 900° C. at the maximum.

After the test, a portion near a front end of the center electrode of each sample was cut along a plane including the axial line CO, and the resulting section was polished and then observed. In the boundary between the center electrode tip and the welded portion on the section, a portion in which separation occurred and a portion in which bonding was maintained were specified. A portion in which bonding is maintained and a portion in which separation occurs can be specified by observing a section with a metallurgical microscope because oxide scale is not generated in the portion in which bonding is maintained whereas oxide scale is generated in the portion in which separation occurs. A ratio of the portion in which separation occurred (may be referred to as a "separation ratio") in the width of the boundary between the center electrode tip and the welded portion in the radial direction was calculated. The sample having a separation ratio of less than 70% was evaluated as "A". The sample having a separation ratio of 70% or more and less than 80% was evaluated as "B". The sample having a separation ratio of 80% or more was evaluated as "C".

Table 2 shows the evaluation results. Samples 20 to 28 had boundary Al concentrations of 1%, 2%, 2%, 3%, 4%, 5%, 8%, 10%, and 11% by weight, respectively. Eight Samples 20 to 27, which had a boundary Al concentration of 10% by weight or less, were evaluated as "B" or higher. Sample 28, which had a boundary Al concentration of more than 10% by weight, was evaluated as "C". The above results showed that the boundary Al concentration was preferably 10% by weight or less from the viewpoint of improving separation resistance.

Furthermore, of eight Samples 20 to 27, which had a boundary Al concentration of 10% by weight or less, six Samples 20 to 25, which had a boundary Al concentration of 5% by weight or less, were evaluated as "A". Of eight Samples 20 to 27, Samples 26 and 27, which had a boundary Al concentration of more than 5% by weight, were evaluated as "B". The above results showed that the boundary Al concentration was more preferably 5% by weight or less from the viewpoint of improving separation resistance.

Figure 8:
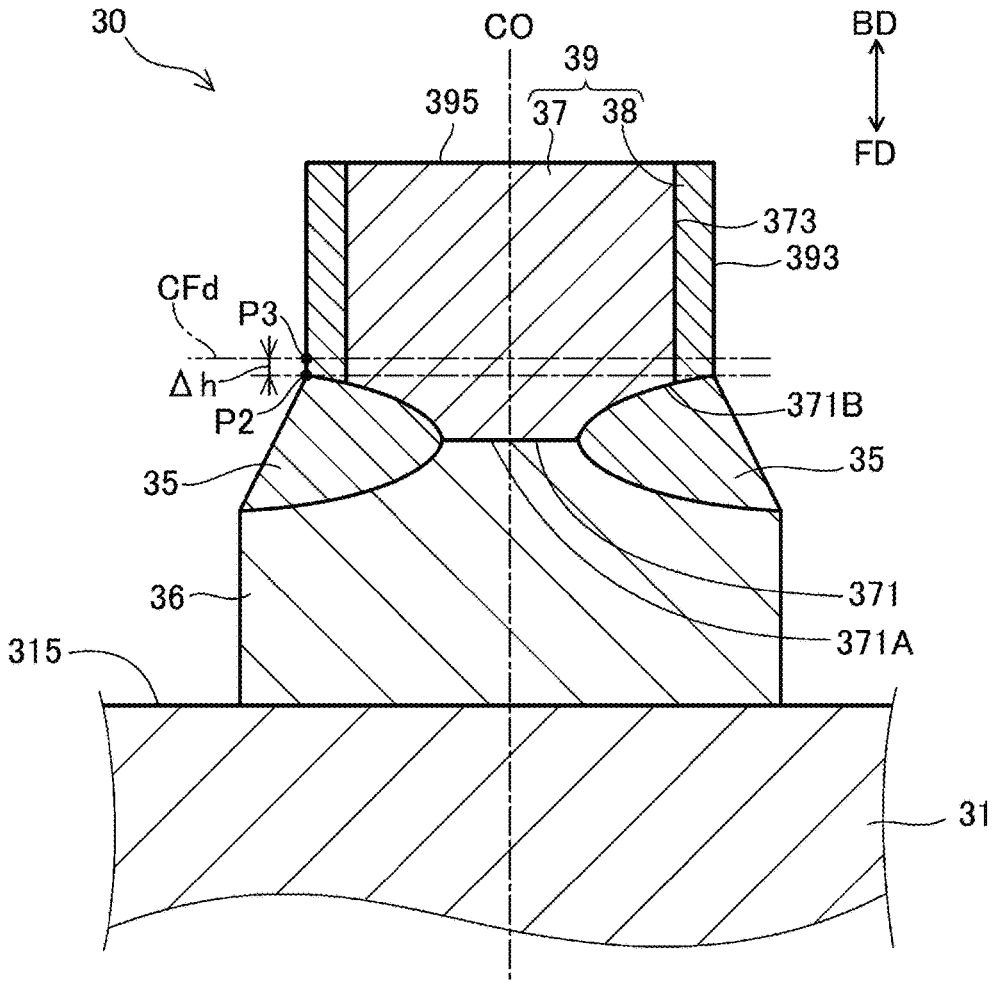
FIG. 8 is a sectional view of a structure around a ground electrode tip 39 of a ground electrode 30 of a modification.

F. Modifications (1) In the embodiments described above, an electrode tip including a cover layer formed of an IrAl intermetallic compound is used in the center electrode 20. Alternatively, the electrode tip may be used in the ground electrode 30. FIG. 8 is a sectional view of a structure around a ground electrode tip 39 of a ground electrode 30 of a modification taken along a plane including an axial line CO.

A ground electrode tip 39 in FIG. 8 includes, as in the center electrode tip 29 of the first embodiment, a tip body 37 formed of Ir or an Ir alloy and a cover layer 38 covering the side surface of the tip body 37 and formed of an IrAl intermetallic compound. A ground electrode body 31 formed of a nickel alloy includes a columnar pedestal 36 bonded to a surface 315 in the backward direction BD and formed of a nickel alloy. The ground electrode tip 39 is bonded to a surface of the pedestal 36 in the backward direction BD by laser welding. Therefore, a welded portion 35 is formed between the pedestal 36 and the ground electrode tip 39.

An opposite surface 371 disposed on the opposite side of a second discharge surface 395 of the ground electrode tip 39 includes a non-contact portion 371A that is not in contact with the welded portion 35, and a contact portion 371B that is disposed outside the non-contact portion 371A and in contact with the welded portion 35.

In the present modification, on a particular section CFc near the boundary between the ground electrode tip 39 and the welded portion 35, the area of the tip body 37 is represented by Sa, and when the non-contact portion 371A is projected on the particular section CFc in the axial line direction, the area of a projection image projected on the tip body 37 is resented by Sb, as in the first embodiment. On the particular section CFc, the area of a portion of the tip body 37 excluding the projection image is represented by Sx=(Sa−Sb). In this case, the area ratio A is 35% or more ($\{(Sa-Sb)/Sa\}\times100\geq35$). As a result, the bonding strength between the ground electrode tip 39 and the ground electrode body 31 can be improved to improve separation resistance of the ground electrode tip 39.

In the present modification, the area ratio A is preferably 45.7% or more. When the area of an exposed portion of surfaces of the ground electrode tip 39 is represented by Sc, the area ratio B is preferably 7% or more ($\{(Sa-Sb)/Sc\}\times100\geq7$). As a result, the bonding strength between the ground electrode tip 39 and the ground electrode body 31 can be improved to further improve separation resistance of the ground electrode tip 39. In the present modification, the boundary Al concentration in the welded portion 35 is preferably 5% by mass or less. As a result, separation resistance of the ground electrode tip 39 can be further improved.

(2) In the embodiments described above, the welded portion 25 is formed over the entire periphery of the side surfaces of the center electrode tip 29 and the center electrode body 21. Alternatively, the welded portion 25 may be intermittently formed on the side surfaces of the center electrode tip 29 and the center electrode body 21 at intervals in the circumferential direction.

Figure 9:
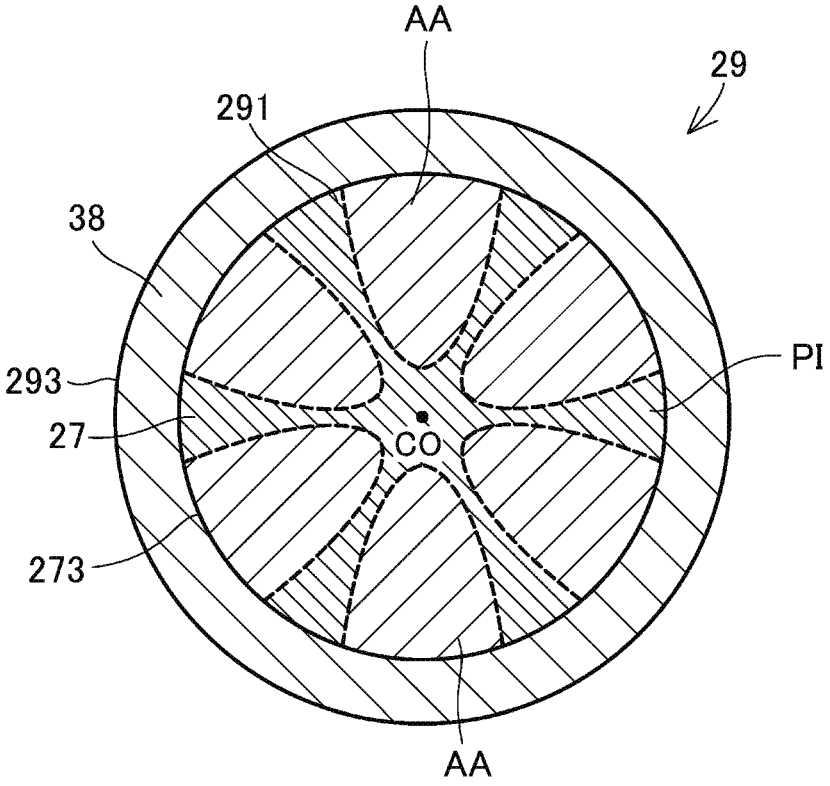
FIG. 9 is a view illustrating a structure around a center electrode tip 29 of a modification.

FIG. 9 is a view illustrating a structure around a center electrode tip 29 of a modification. FIG. 9 illustrates a particular section CF of a center electrode tip 29 of a modification, the particular section CF being located at the same position as the section in FIG. 2B. In this example, six welded portions 25 are formed along the side surfaces of the center electrode tip 29 and a center electrode body 21 at intervals of 60 degrees in the circumferential direction (not shown). Therefore, as illustrated in FIG. 9, a projection image PI of a non-contact portion 271A projected on the particular section CF extends not only to a central portion that intersects the axial line CO but also to the side surface of the tip body 27 at positions where the welded portions 25 are not formed, the positions being located in the circumferential direction. On the particular section CF, the shape of a portion AA of the tip body 27 excluding the projection image PI is divided into six parts corresponding to the six welded portions 25 that are formed at intervals of 60 degrees in the circumferential direction.

In the present modification, the area ratio A is 35% or more. The area ratio A is preferably 45.7% or more. The area ratio B is preferably 7% or more.

(3) In the embodiments and the modifications, the center electrode tip 29 and the ground electrode tip 39 each have a columnar shape. Alternatively, the center electrode tip 29 and the ground electrode tip 39 may have other shapes such as a quadrangular prism shape and a pentagonal prism shape.

(4) In the modification in FIG. 8, the pedestal 36 may be omitted. The ground electrode tip 39 may be directly bonded to the surface of the ground electrode body 31 in the backward direction BD by laser welding.

(5) The materials and dimensions of the ground electrode 30, the metal shell 50, the center electrode 20, the insulator 10, and other components in the spark plug 100 may be appropriately changed. For example, the material of the metal shell 50 may be low-carbon steel plated with zinc or nickel or low-carbon steel that is not subjected to plating. The material of the insulator 10 may be an insulating ceramic other than alumina. The material of the center electrode body 21 is not limited to INC600, INC601, Alloy601, and Alloy602. The center electrode body 21 may be formed of Ni or another alloy containing Ni in an amount of 50% by weight or more.

Although the present invention has been described on the basis of embodiments and modifications, the above-described embodiments of the present invention are intended to facilitate understanding of the present invention, and do not limit the present invention. The present invention allows modifications and improvements without departing from the spirit of the present invention and the scope of the claims and includes equivalents thereof.

What is claimed is:

1. A spark plug comprising:

a center electrode; and a ground electrode disposed so as to form a gap between the center electrode and the ground electrode, wherein at least one of the center electrode and the ground electrode includes an electrode body, an electrode tip having a discharge surface that faces the gap, and a welded portion formed between the electrode body and the electrode tip and containing a component of the electrode body and a component of the electrode tip, the electrode tip includes:

a tip body comprising a side surface extending in a direction that intersects the discharge surface, and an opposite surface which is disposed on an opposite side of the discharge surface, at least a part of which is in contact with the welded portion and a part of which is a non-contact portion not in contact with the welded portion and a cover layer that covers at least the side surface of the tip body, the tip body comprises iridium (Ir) or an alloy containing iridium (Ir) as a main component, the cover layer comprises an intermetallic compound (IrAl) of iridium (Ir) and aluminum (Al) and having a thickness of 50 μm or less, the electrode body comprises an alloy containing 50% by weight or more of nickel (Ni), and wherein "Sa" is defined as an area of a section through the tip body along a plane located near but not intersecting the welded portion, and parallel to the discharge surface, wherein "Sb" is defined as an area of a projection of the non-contact portion of the opposite surface on the section in a direction perpendicular to the discharge surface, and wherein Sa−Sb corresponds to 35% or more of Sa.

2. The spark plug according to claim 1, wherein Sa−Sb corresponds to 45.7% or more of Sa.

3. The spark plug according to claim 1, wherein "Sc" is defined as an area of an exposed portion of a surface of the electrode tip, and Sa−Sb corresponds to 7% or more of Sc.

4. The spark plug according to claim 1, wherein a content of aluminum (Al) in the welded portion in a vicinity of a boundary between the tip body and the welded portion is 10% by mass or less.

5. The spark plug according to claim 4, wherein the content of aluminum (Al) in the welded portion in a vicinity of a boundary between the tip body and the welded portion is 5% by mass or less.

* * * * *